US005509345A

United States Patent [19]

Cyktich

[11] Patent Number: 5,509,345

[45] Date of Patent: Apr. 23, 1996

[54] MUZZLE ATTACHMENT FOR IMPROVING FIREARM ACCURACY

[76] Inventor: James M. Cyktich, P.O. Box 2471, Everett, Wash. 98203

[21] Appl. No.: 289,946

[22] Filed: Aug. 12, 1994

Related U.S. Application Data

[63] Continuation-in-part of Ser. No. 186,626, Jan. 26, 1994, abandoned.

[51] Int. Cl.[6] ..... F41A 21/32; F41A 21/38

[52] U.S. Cl. ..... 89/14.05; 42/97; 89/14.3

[58] Field of Search ..... 42/79, 97; 89/14.05, 89/14.2, 14.3, 14.4; 181/223; D22/108

[56] References Cited

U.S. PATENT DOCUMENTS

| | | | |
|---|---|---|---|
| 459,689 | 9/1891 | Short | 191/59.1 |
| 785,975 | 3/1905 | McClean | 89/14.3 |
| 812,140 | 2/1906 | Kent | 89/14.3 |
| 1,143,814 | 6/1915 | De Vries | 89/14.4 |
| 1,259,251 | 3/1918 | Love | 89/14.4 |
| 1,429,619 | 9/1922 | Nelson | 89/14.3 |
| 1,598,360 | 8/1926 | Pavek | 89/14.3 |
| 1,892,522 | 12/1932 | White | 42/79 |
| 2,014,184 | 9/1935 | Linder | 42/76.01 |
| 2,065,273 | 12/1936 | Galliot | 89/14.3 |
| 2,092,649 | 9/1937 | Jung | 42/79 |
| 2,101,850 | 12/1937 | Green | 89/14.2 |
| 2,112,831 | 4/1938 | Cutts, Jr. | 89/14.3 |
| 2,153,246 | 4/1939 | Gibson | 42/79 |
| 2,165,457 | 7/1939 | Cutts, Jr. | 89/14.3 |
| 2,191,484 | 2/1940 | Hughes | 89/14.3 |
| 2,192,081 | 2/1940 | Hughes | 89/14.3 |
| 2,206,567 | 7/1940 | Hughes | 89/14.3 |
| 2,206,568 | 7/1940 | Hughes | 89/14.3 |
| 2,212,683 | 8/1940 | Hughes | 89/14.3 |
| 2,212,686 | 8/1940 | Hughes | 89/14.3 |
| 2,302,699 | 11/1942 | Klipsch | 42/97 |
| 2,322,370 | 6/1943 | Lance | 89/14.3 |
| 2,340,821 | 2/1944 | Russell | 42/76.01 |
| 2,348,114 | 5/1944 | Dow | 89/14.3 |
| 2,398,298 | 4/1946 | Finlay et al. | 42/79 |
| 2,428,232 | 9/1947 | Limon | 42/79 |
| 2,442,899 | 6/1948 | McAllister | 42/79 |
| 2,447,205 | 8/1948 | Powell | 42/79 |

(List continued on next page.)

FOREIGN PATENT DOCUMENTS

| | | |
|---|---|---|
| 96967 | 9/1963 | Denmark . |
| PCT/US83/ 00984 | 1/1985 | European Pat. Off. . |
| 579306 | 1/1994 | European Pat. Off. . |
| 298036 | 4/1922 | Germany . |
| 1230334 | 12/1966 | Germany . |
| 333851 | 1/1936 | Italy . |
| 401021 | 1/1943 | Italy . |
| 454533 | 10/1936 | United Kingdom . |
| 569476 | 5/1945 | United Kingdom . |

*Primary Examiner*—Stephen C. Bentley
*Attorney, Agent, or Firm*—Delbert J. Barnard; David P. Campbell

[57] ABSTRACT

A tubular adapter (12) is clamped onto the muzzle (16) of a firearm (18). The adapter (12) is axially split where it surrounds the muzzle (16). A clamp ring (38) surrounds fingers (44) which are between the splits (28) and squeezes the fingers (44) diametrically inwardly into tight clamping engagement with the muzzle (16). The clamp ring (38) is made from a material that shrinks when it is heated. The adapter (12) includes external threads (20) and axial grooves (64) formed in the threads (20) which are spaced circumferentially about the adapter (12). A tubular weight member (14) is attached to the adapter (12) by internal threads (26) which mate with the external threads (20) on the adapter. One or more detent balls (46, 48) carried by the weight (14) enter into the grooves (64) and serve to lock the weight (14) into set positions on the adapter (12). The detent bails (46, 48) and grooves (64) provide for an axial position adjustment of the tubular weight (14) in discreet increments. A spring ring (56) surrounds the detent balls (46, 48) and biases them radially inwardly into the grooves (64). The tubular weight (14) may be provided with sidewall openings (70) for releasing gases so that the tubular weight (14) also functions as a muzzle brake.

27 Claims, 3 Drawing Sheets

U.S. PATENT DOCUMENTS

| | | | |
|---|---|---|---|
| 2,453,121 | 11/1948 | Cutts | 89/14.3 |
| 2,453,747 | 11/1948 | Egleson | 42/79 |
| 2,466,104 | 4/1949 | Hilburn | 42/79 |
| 2,499,428 | 3/1950 | Tiffany | 89/14.3 |
| 2,558,200 | 6/1951 | Schmeling | 42/79 |
| 2,589,171 | 3/1952 | Vironda | 42/79 |
| 2,589,738 | 3/1952 | Sedberry | 42/79 |
| 2,629,958 | 3/1953 | Roper et al. | 42/79 |
| 2,656,637 | 10/1953 | Richards | 42/79 |
| 2,662,326 | 12/1953 | Powell | 42/79 |
| 2,667,815 | 2/1954 | Strong | 89/14.3 |
| 2,699,094 | 1/1955 | Musser | 89/1.7 |
| 2,700,839 | 2/1955 | Finlay et al. | 42/79 |
| 2,712,193 | 7/1955 | Mathis | 42/79 |
| 2,796,005 | 6/1957 | Shapel | 89/14.3 |
| 2,852,983 | 9/1958 | Netzer | 89/14.3 |
| 2,899,866 | 8/1959 | Clark et al. | 89/14.3 |
| 2,921,396 | 1/1960 | Larson | 42/97 |
| 2,953,972 | 9/1960 | Sorenson | 89/14.3 |
| 3,021,633 | 2/1962 | Beretta | 42/105 |
| 3,115,060 | 12/1963 | Ashbrook et al. | 89/14.3 |
| 3,141,376 | 7/1964 | Chinn | 89/14.3 |
| 3,152,510 | 10/1964 | Ashbrook et al. | 89/14.3 |
| 3,155,003 | 11/1964 | Ruth | 89/14.3 |
| 3,187,632 | 6/1965 | Harvey | 89/14.05 |
| 3,202,056 | 8/1965 | Seeberger | 89/14.3 |
| 3,340,641 | 9/1967 | Recker | 42/97 |
| 3,455,203 | 7/1969 | Pillersdorf | 89/14.3 |
| 3,492,912 | 2/1970 | Ashbrook | 89/14.3 |
| 3,528,336 | 9/1970 | Donner | 89/14.3 |
| 3,604,136 | 9/1971 | Edwards | 42/97 |
| 3,698,747 | 10/1972 | Wing et al. | 285/305 |
| 3,732,776 | 5/1973 | Snodgrass | 89/14.5 |
| 3,858,481 | 1/1975 | Elliott | 89/14.3 |
| 4,322,999 | 4/1982 | Aston | 89/14.3 |
| 4,341,283 | 7/1982 | Mazzanti | 181/223 |
| 4,510,843 | 4/1985 | Rabatin | 89/14.4 |
| 4,558,832 | 12/1985 | Nilsson | 242/107 |
| 4,562,767 | 1/1986 | Janssen et al. | 89/14.3 |
| 4,583,445 | 4/1986 | Blair | 89/14.2 |
| 4,677,376 | 6/1987 | Ettel et al. | 324/179 |
| 4,726,280 | 2/1988 | Frye | 89/16 |
| 4,869,151 | 9/1989 | Chahin | 89/14.3 |
| 4,879,942 | 11/1989 | Cave | 89/14.3 |
| 4,897,942 | 11/1989 | Cave | 89/14.3 |
| 4,910,904 | 3/1990 | Rose | 42/73 |
| 4,971,208 | 11/1990 | Reinfried, Jr. et al. | 211/64 |
| 5,058,302 | 10/1991 | Minneman | 42/94 |
| 5,092,223 | 3/1992 | Hudson | 89/14.2 |
| 5,173,563 | 12/1992 | Gray | 42/94 |
| 5,279,200 | 1/1994 | Rose | 89/14.3 |
| 5,305,834 | 4/1994 | White | 171/63 |

MUZZLE ATTACHMENT FOR IMPROVING FIREARM ACCURACY

RELATED APPLICATION

This is a continuation-in-part of my application Ser. No. 186,626, filed Jan. 26, 1994, and entitled Method and Apparatus For Attaching A Cylindrical Article To Another Cylindrical Article, now abandoned.

TECHNICAL FIELD

This invention relates to an attachment for the muzzle of a firearm for improving accuracy of the firearm. More particularly, the invention relates to the provision of a muzzle weight or vibration modifier that is adjustable in position lengthwise of the muzzle in discreet increments, for improving accuracy by modulating barrel harmonics. The invention also relates to such an apparatus that is also a muzzle brake and which is attachable to muzzles that are not threaded.

BACKGROUND OF THE INVENTION

It is well known to improve the accuracy of firearms by adding weight to the firearm barrel and adjusting the weight in position lengthwise of the barrel to modulate barrel vibration or harmonics. U.S. Pat. No. 5,279,200, granted Jan. 18, 1994 to Clyde E. Rose, and entitled Ballistic Optimizing System For Rifles, discloses thread connecting a weight to a threaded muzzle of a firearm barrel and adjusting the axial position of the weight by rotating it on the threads and then locking it into the desired position by use of a lock nut which is a part of the effective added weight. The threads and the lock nut make the weight continuously and infinitely adjustable in position along the barrel.

Prior practices of attaching weights to rifle barrels for the purpose of dampening barrel vibrations are discussed in the "State of the Art" portion of U.S. Pat. No. 5,279,200. In that discussion, reference is made to U.S. Pat. No. 4,726,280, granted Feb. 23, 1988, to Guenter Frye, and entitled Mounting Of A Muzzle Member On A Gun Barrel. The muzzle member disclosed by this patent serves as a counterweight on the muzzle. The muzzle member is threaded onto the barrel and is locked in place by a lock composed of a rod positioned radially between a groove in the weight and a recess in the barrel. The prior art discussion also makes reference to barrel weights available from Anshutz and Co. G. M. P., which enable a marksman to selectively vary the amount of weight used for dampening barrel vibrations. It is also known that olympic shooters have for years attached sliding weights to rifle barrels for improving accuracy.

Muzzle brakes are also well-known in the prior art. A muzzle brake serves to reduce the recoil that is produced by the discharge of gases from the barrel after a round is fired. The muzzle brake reduces recoil by diverting some of the gases in directions which are at angles to the line of fire. The installation of a muzzle brake onto a firearm barrel inherently adds weight to the barrel. As should be apparent, if this weight is properly positioned on the barrel, it will modulate barrel vibration. U.S. Pat. No. 3,202,056, granted Aug. 24, 1965, to Curt Seeberger, and entitled Fire Arm Muzzle Brake, discloses a muzzle brake that is thread-connected to a threaded muzzle of a rifle barrel. The aforementioned U.S. Pat. No. 5,279,200 discloses a muzzle attachment that is a recognized combination muzzle brake and vibration dampener.

The muzzle attachment disclosed by U.S. Pat. No. 5,279,200 cannot be used on firearm barrels which are not threaded. Also, such attachment requires the use of a lock nut. It is well known to those skilled in the firearm art that the pressures, forces and vibrations involved at the muzzle of a firearm barrel when a round is fired are such that any member attached to the barrel must be made of high strength materials and must be securely attached. Lock nuts are not generally recognized as secure attachments unless they are safety-wired and/or tightened with appropriate tools. U.S. Pat. No. 5,279,200 makes no provision for either lock wiring or use of appropriate tools in the adjustment in position of the muzzle attachment.

There is a need for a vibration modifier that is easily adjustable in position and is securely lockable into each selected position. There is also a need for a vibration modifier that is connectable to a muzzle that is not threaded. The principal object of the present invention is provide a vibration modifier, and a combined muzzle brake and vibration modifier, which meets these needs.

DESCRIPTION OF THE INVENTION

Vibration dampeners of the present invention are basically characterized by a tubular weight that is attachable to the muzzle of the barrel by a threaded connection such that the tubular weight can be rotated to adjust it in position in discreet increments axially along the firearm barrel, for purpose of changing the effective weight applied for dampening purposes. According to the invention, fixed external threads are provided on the muzzle, preferably by use of an adapter that carries the threads and is clamped onto the barrel. A plurality of radial outwardly opening axial grooves are formed in the external threads and are spaced circumferentially about the muzzle. The tubular weight is provided with an axial opening having internal threads which mate with the external threads. The tubular weight also includes at least one detent ball that projects radially inwardly from the internal threads of the tubular weight, for selective entry into the grooves in the external threads, one groove at a time, in response to the tubular weight being rotated. Engagement of the detent ball(s) within a groove locks the tubular weight in position relative to the muzzle. The detent ball(s) and grooves provide for an axial position adjustment of the tubular weight in discreet increments.

In preferred form, a tubular adapter is provided which is attachable to the muzzle of the firearm barrel. The external threads and the grooves are on said adapter. Preferably, the tubular adapter includes first and second opposite end portions. The first end portion includes the external threads and grooves and the second end portion includes a plurality of axial slits which are spaced circumferentially about the second end portion of the adapter and axial fingers between the slits. A clamp ring surrounds the second end portion of the adapter and functions to squeeze radially inwardly on the fingers for clamping the adapter onto the muzzle. Preferably, the clamp ring is a ring of a temperature change responsive material which shrinks when subjected to the appropriate change in its temperature. Shrinkage of the ring clamps the adapter in place on the firearm barrel.

According to an aspect of the invention, the tubular weight includes a spring that is radially outwardly of the detent ball(s). The spring biases the detent ball(s) radially inwardly. The detent ball(s) acts outwardly on the spring during rotation of the tubular weight about the muzzle from each groove to the next groove. In preferred form, the spring is a one piece axially split spring ring. The spring ring includes a space at the axial split large enough to pass a detent ball. In the preferred embodiment, the tubular weight includes an inwardly tapering radial opening for each detent ball and the detent ball is positioned within the opening. The spring ring is rotatable or shiftable in position relative to the tubular weight between a first position in which the space is radially outwardly of the radial opening and a second position in which the space is circumferentially to one side of the opening. In use, the spring ring is rotated into the first position to permit a detent ball to be either inserted into or removed out from the detent ball receiving opening via said space. The spring ring is moved into its second position to place a portion of the spring ring outwardly of the detent ball and its detent ball receiving opening. In preferred form, when the spring ring is in its second position, a block member is inserted into the space and is connected to the tubular weight for blocking the spring ring against a circumferential shifting in position about the tubular weight. The preferred embodiment includes two detent balls, circumferentially spaced apart on opposite sides of the block member. These detent balls act on end portions of the spring ring and deflect them radially outwardly when the detent bails are moved out of grooves and up on the external threads during rotation of the tubular weight.

Other objects, features and advantages of the invention are hereinafter specifically described in or apparent from the description of the best mode and alternative embodiments.

BRIEF DESCRIPTION OF THE DRAWINGS

Like reference numerals are used to designate like parts throughout the several views of the drawing, and.

BEST MODE FOR CARRYING OUT THE INVENTION

Figures 1, 2, 3:
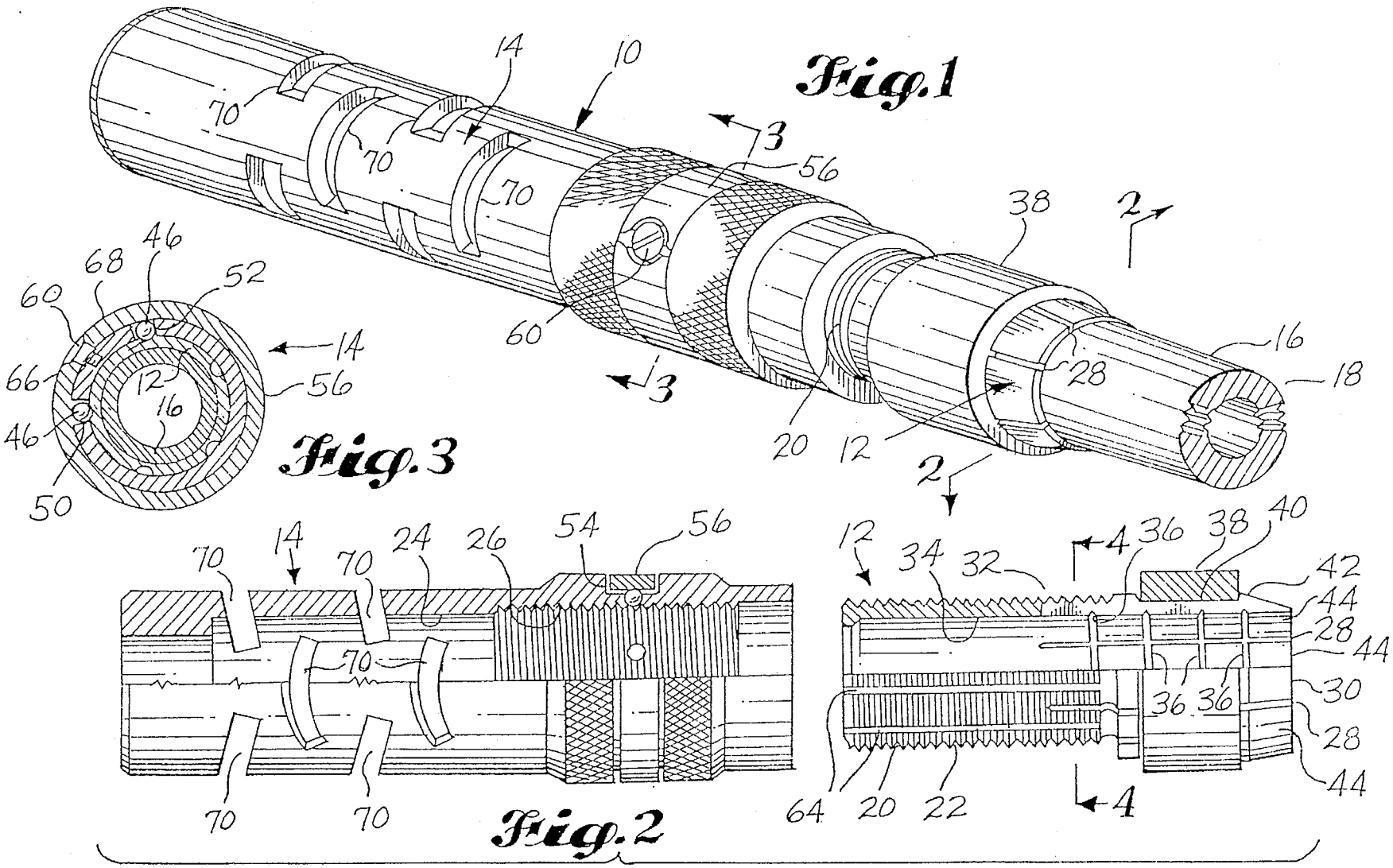
FIG. 1 is a pictorial view showing a vibration dampening apparatus embodying the invention which also serves as a muzzle break, such apparatus being shown attached to the muzzle of a firearm barrel.
FIG. 2 is a view of the apparatus shown by FIG. 1, shown partially in side elevation and partially in section, with the section being taken substantially along 2—2 of FIG. 1.
FIG. 3 is a cross-sectional view taken substantially along 3—3 of FIG. 1.

The preferred embodiment or "best mode" is a combined vibration modifier and muzzle brake and is designated 10 in FIG. 1. The muzzle brake/vibration modifier 10 is composed of an adapter 12 and a tubular weight member 14. Tubular weight member 14 may also be simply termed a "tubular weight." As shown in FIG. 1, adapter 12 is clamped to the muzzle 16 of a firearm barrel 18. As shown in FIG. 2, the adapter 12 has threads 20 on a portion of its exterior surface 22. The member 14 includes an axial opening 24 which extends throughout its length. A portion of the axial opening 24 includes internal threads 26 which engage the external threads 20 on adapter 12. The member 14 is attached to the adapter 12 by these engaging threads. Member 14 is rotated relative to adaptor 12 to cause travel of the member 14 along the threads 20. It is by this rotation that the member 22 is adjusted in position axially along the muzzle 16.

In the preferred embodiment, the adapter 12 includes a plurality of axial splits 28. Splits 28 are open at the inboard end 30 of adapter 12. Splits 28 extend axially of adaptor 12 from end 30 to approximately a mid-length location 32. The interior surface 34 of adapter 12 may have a plurality of circumferential grooves 36 for enhancing attachment of the adapter 12 onto the muzzle 16. The muzzle 16 is telescopically received within the split portion of the tubular adapter 12. A clamp ring 38 extends about the axially split portion of adapter 12. As shown by FIG. 2, clamp ring 38 fits within a girth groove 40 which is a radially outwardly opening girth channel formed in a sidewall portion of adapter 12, radially outwardly of the splits 28 and the grooves 36. Clamp ring 38 is a continuous ring that is installed within girth groove 40 by forcing it endwise over rim 42. The axial slots 28 permit a collapsing of the diameter of rim 42 by an amount sufficient to allow movement of clamp ring 38 over the collapsed rim 42 and into the girth groove 40. Clamp ring 40 is made of a temperature change responsive material (e.g. NITINOL™) which shrinks when subjected to the appropriate change in its temperature. Shrinkage of the clamp ring 38 clamps the adapter 12 onto the muzzle 16. Specifically, the clamp ring 38 moves the fingers 44 radially inwardly into tight clamping engagement with the muzzle 16. As previously stated, the circumferential grooves 36 enhance the clamping action. This clamping method and apparatus for attachment are disclosed in my co-pending U.S. application Ser. No. 186,626, filed Jan. 26, 1994, the contents of which are hereby incorporated by this specifc reference.

Figure 8:
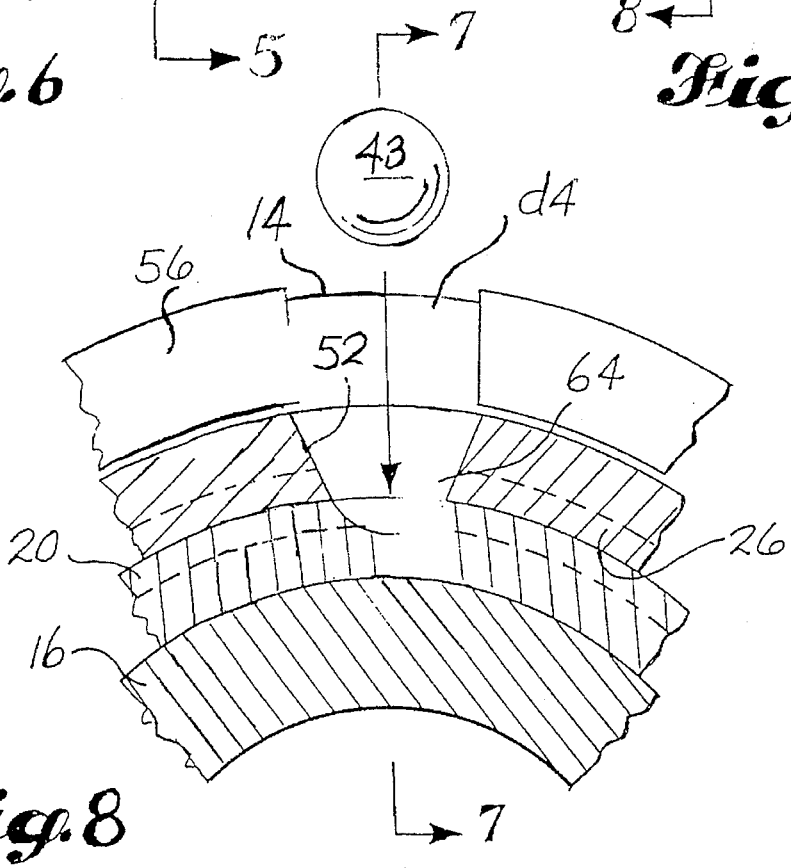
FIG. 8 is a sectional view taken along line 8—8 of FIG. 7, such view also showing the detent ball spaced radially outwardly from a detent ball receiving opening.

In accordance with the present invention, a detent type lock is provided between member 14 and adapter 12 for locking member 14 into a number of selected positions relative to adapter 12 and muzzle 16. In performed form, the detent comprises detent balls 46, 48 located within detent ball receiving openings 50, 52. These openings 50, 52 are radially inwardly tapering openings. The detent balls 46, 48 each have a diameter d1 which is larger than the diameter d2 at the small ends of the openings 50, 52. As shown in FIG. 2, in the preferred embodiment the openings 50, 52 are in the internally threaded region of the member 14. An annular girth groove 54 is formed in the sidewall of member 14 where it surrounds openings 50, 52. A one-piece axially split ring spring 56 is received within the girth groove 54. A gap or space d4 is provided at the axial split. Gap d4 is larger than the detent ball diameter d1. The detent balls 46, 48 are installed and removed via the gap d4. The spring ring 56 is rotated or moved circumferentially about member 14 until the gap d4 is radially outwardly of a detent ball receiving opening 52, such as shown in FIG. 8. Then, a detent ball 48 is moved through gap d4 into the opening 52. Then, the spring ring 56 is rotated so as to move the gap d4 away from the detent ball 48 and into a position radially outwardly of a threaded socket 58 that is formed in member 14, circumferentially removed from the detent ball 48. A machine screw 60 is then moved through the gap d4 and its threaded shank 62 is screwed into the threaded socket 58. Machine screw 60 has a head portion which is of a diameter slightly smaller than the gap diameter d4. Machine screw 60 functions as a block member which prevents the spring ring 56 from rotating or shifting circumferentially in position back into alignment with a detent ball 46, 48. In this manner unintentional removal of one or both of the detent balls 46, 48 is prevented.

Figure 4:
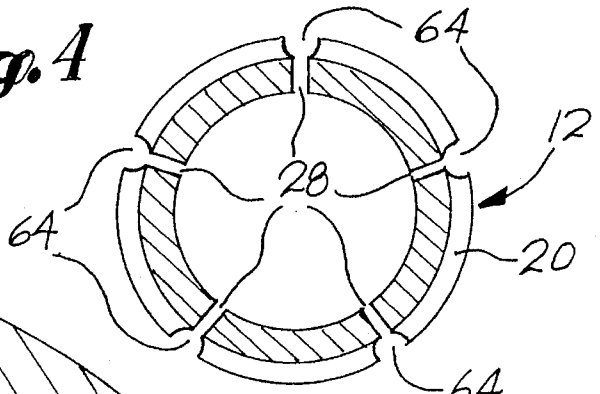
FIG. 4 is an enlarged scale cross-sectional view taken substantially along 4—4 of FIG. 2.
Figure 5:
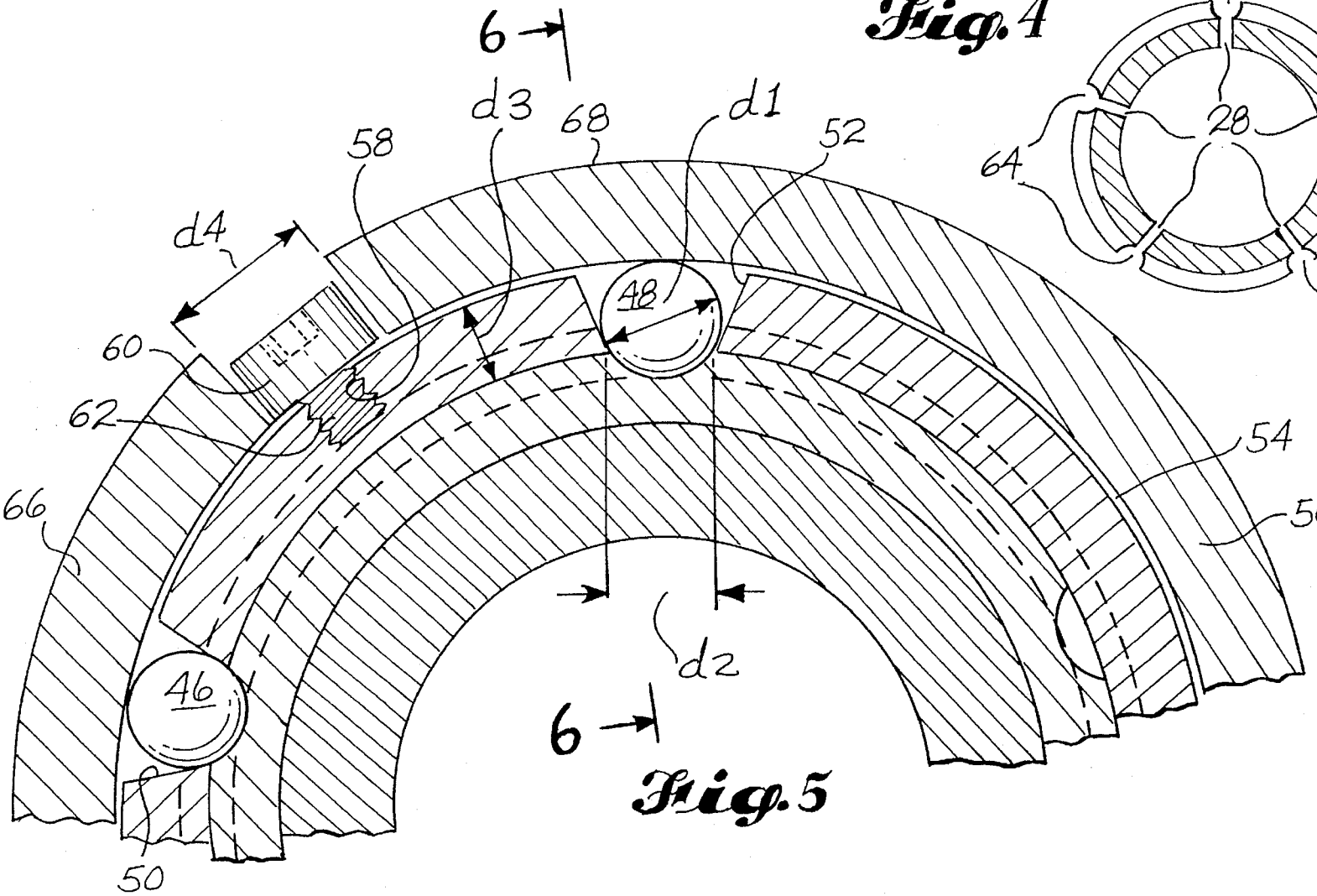
FIG. 5 is an enlarged scale portion of FIG. 3.
Figure 6:
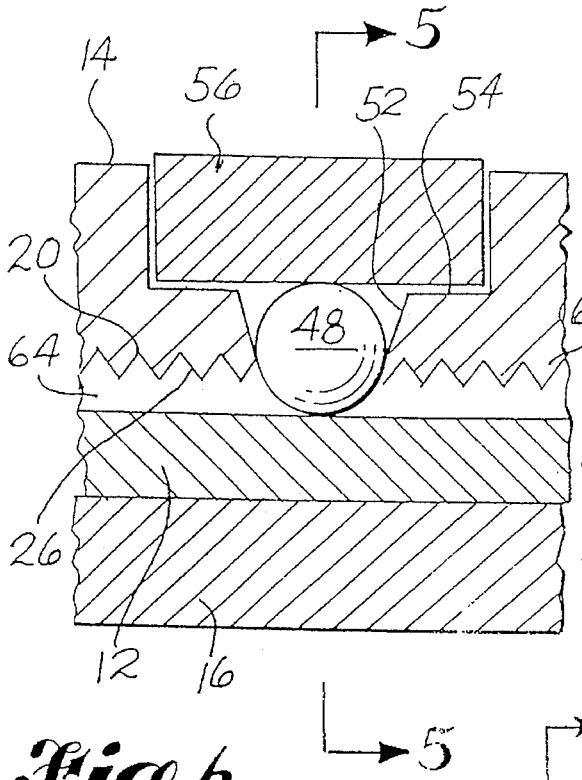
FIG. 6 is a fragmentary sectional view taken substantially along lines 6—6 of FIG. 5.
Figure 7:
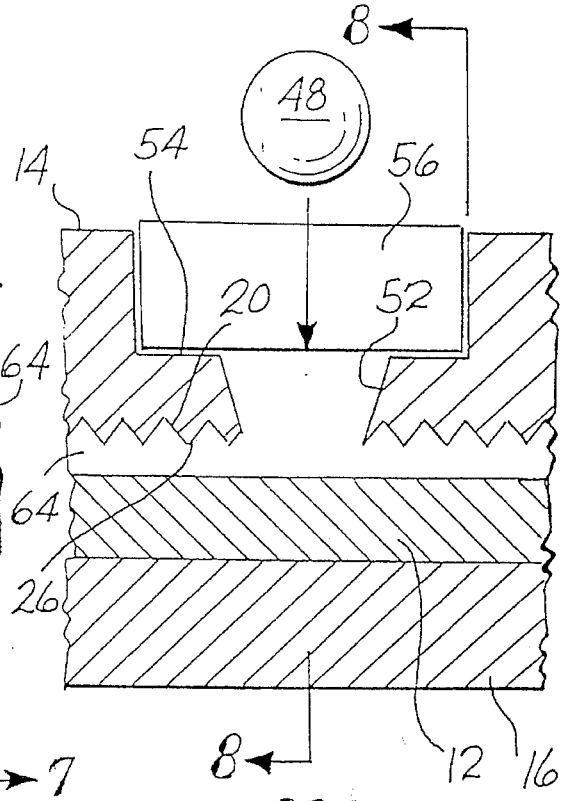
FIG. 7 is a sectional view taken substantially along line 7—7 of FIG. 8, showing the spring ring rotated in position to place its gap radially outwardly of a detent ball receiving opening, such views showing a detent ball spaced radially outwardly from such opening.

As shown by FIGS. 5 and 6, the detent ball diameter d1 is larger than the radial dimension d3. Thus, when the spring ring 56 is in the position shown by FIGS. 5 and 6, its inner surface will bear on the detent balls 46, 48 and hold them into positions wherein inner portions of the detent balls 46, 48 project radially inwardly from the inner boundary of member 14. Spring ring 56 may include a concave shallow groove where it contacts the detent balls 46, 48. This groove (not shown) extends circumferentially and may be about 0.030 inches deep. When the detent balls 46, 48 are seated, their outer portions press against the spring ring 56. As shown by FIGS. 2–8, the adapter 12 is formed to include a plurality of radially outwardly opening axial grooves 64. As shown by FIG. 2, the grooves 64 are preferably formed in the externally threaded region of the adapter 12. They are circumferentially spaced apart by a distance sufficient such that when the detent ball 46 is in a first groove 64, the detent ball 48 is in a second groove 64. These may be circumferentially adjacent grooves 64 or grooves 64 separated from each other by an intermediate groove, as will hereinafter be described in more detail.

The preferred embodiment includes two detent balls 46, 48, separated by an angle of about seventy-two degrees (72°) to about two hundred and eighty-eight degrees (288)°. The position block 60 for the ring spring 56 is located substantially circumferentially between the detent balls 46, 48. In FIG. 5, the detent balls 46, 48 are about seventy-two degrees (72°) apart. As a result, the contact of the detent balls 46, 48 is with end portions 66, 68 of ring spring 56. This positioning makes it is easier to expand the ring spring 56 at its end portions 66, 68. The larger angles make it more difficult to expand the ring spring 56. Adjusting the angle between the detent balls provides a way of adjusting the biases of the spring ring 56 on the detent balls 46, 48 and the grip of the detent balls on the grooves.

Prior to operation, the adapter 12 is clamped onto the muzzle 16 in the manner described above. This can be done with the member 14 attached to the adapter 12. Or, the adapter 12 can be by itself clamped onto the muzzle 16 and the member 14 later attached to the adapter 12. As will be apparent, rotation of the member 14 about the adapter 12 will cause the threads 26 to move axially along the threads 20. It will also cause the detent balls 46, 48 to move circumferentially in position about the adapter 12, each from one groove 64 to another groove. As the member 14 is rotated, the detent balls 46, 48 are displaced radially outwardly by the threads 22 and are moved radially against the end portions 66, 68 of the ring spring. In response, the end portions 66, 68 of the ring spring 46 deflect outwardly, to permit the rotation of member 14. Rotation of member 14 also results in an axial shifting in position of the detent balls 46, 48. Slots 64 accommodate this axial movement. That is, the detent balls 46, 48 may in a start position be into circumferentially adjacent grooves 64, for example. Member 14 may then be rotated a full turn to place the detent balls 46, 48 back in the same two grooves. However, because of thread travel, the detent balls 46, 48 will return to the grooves 64 in axially shifted positions. As shown by FIG. 4, the adapter 12 may comprise five splits 28 spaced seventy-two degrees (72°) apart and five grooves 64, also spaced seventy-two degrees (72°) apart. Or, there may be five splits 28 and ten grooves 64. Or some other number of grooves 64 may be used, e.g. fifteen. Also, the number of detent balls 46, 48 may vary. In preferred form, there are five grooves 64, ten grooves 64 or fifteen grooves 64 and two detent balls 46, 48. The detent mechanism that has been described provides adjustment of the member 14 in discreet increments. If five grooves 64 are used, to rotational length of the increments is seventy-two degrees (72°). If ten grooves 64 are used, the rotational increments are thirty-six degrees (36°). The thread pitch may vary and it is what determines the amount of axial travel of member 14 in response to each increment of rotation. The mechanism may be provided with gauge marks for indicating the position of member 14 in terms of increments of rotation.

As shown in FIGS. 1 and 2, member 14 may be provided with sidewall openings 70 so that it functions as a muzzle brake as well as a vibration modifier. As will be apparent, the mechanism 10 is retrofittable on firearms and does not depend on a threaded barrel. It is easily attached to the firearms and each adjustment is easily made without the use of any type of tool. The member 14 is readily and accurately settable into a position in which for a given firearm barrel and/or ammunition it advantageously modifies the vibration of the barrel so that a more accurate shot can be made. Although use of adapter 12 is preferred, a threaded barrel could be provided with axial grooves and a member 14 could be provided for such barrel.

The scope of the invention is not to be limited by the description and illustration of the preferred and alternative embodiments. Rather, the scope of protection is to be determined by use of established rules of patent claim interpretation, including use of the doctrine of equivalents.

What is claimed is:

1. A vibration dampening attachment for a firearm barrel of a type having a circumferentially continuous tubular muzzle, said attachment including a tubular weight attachable to the muzzle by a threaded connection such that the tubular weight can be rotated to adjust it in position axially along the muzzle, so as to change the effective weight applied for barrel vibration dampening purposes, and the improvement comprising:

fixed external threads on the muzzle and a plurality of elongated axial grooves formed in the external threads and spaced circumferentially about the muzzle between threaded segments;

said tubular weight including an axial opening with internal threads which mate with said external threads; and at least one detent ball carried by the tubular weight and projecting radially inwardly from the internal threads of the tubular weight, for entry into said elongated axial grooves, one groove at a time, in response to the tubular weight being rotated about the muzzle, wherein engagement of the detent ball within a groove holds the tubular weight in position relative to the muzzle, and wherein said detent ball and grooves provide for an axial position adjustment of the tubular weight in discreet increments axially along the barrel.

2. A vibration dampening attachment according to claim 1, wherein said tubular weight includes a spring radially outwardly of the detent ball, said spring biasing the detent ball radially inwardly, and said detent ball acting radially outwardly on the spring during rotation of the tubular weight about the muzzle for moving the detent ball from a groove that it was in on to the next groove.

3. A vibration dampening attachment according to claim 2, wherein the spring is a one piece axially split spring ring.

4. A vibration dampening attachment according to claim 3, wherein said spring ring includes a space at the axial split, and the attachment includes a block member in said space which is separate from the spring ring and is connected to the tubular weight and blocks said spring ring against a circumferential shifting in position about the tubular weight.

5. A vibration dampening attachment according to claim 4, wherein said tubular weight includes an inwardly tapering radial opening and said detent ball is positioned within said opening, and said spring ring is rotatable about the tubular weight between a first position in which the space is radially outwardly of the radial opening, permitting the detent ball to be inserted into and removed out from the radial opening via said space, and a second position in which the space is circumferentially to one side of said opening and a portion of said spring ring surrounds and is in contact with the detent ball.

6. A vibration dampening attachment according to claim 3, wherein said tubular weight includes a radially outwardly opening girth groove and said spring ring is located within said girth groove.

7. A vibration dampening attachment for a firearm barrel of a type having a circumferentially continuous tubular muzzle, said attachment including a tubular weight attachable to the muzzle by a threaded connection such that the tubular weight can be rotated to adjust it in position axially along the muzzle, so as to change the effective weight applied for barrel vibration dampening purposes, and the improvement comprising:

a tubular adapter attachable to the muzzle, said tubular attachment including fixed external threads and at least one first component of a detent;

said tubular weight including an axial opening with internal threads which mate with said external threads, and at least one second component of a detent;

wherein said first component of a the detent is an elongated axial groove formed in the external threads on the adapter;

wherein said second component of the detent is a detent ball carried by the tubular weight and projecting radially inwardly from the internal threads of the tubular weight, each for entry into a said groove;

wherein there is a plurality of at least one of said first and second components of the detent spaced circumferentially about the muzzle;

wherein engagement of a detent ball within a groove holds the tubular weight into position relative to the muzzle; and wherein the first and second components of the detent provide for axial position adjustment of the tubular weight in discreet increments axially along the firearm barrel.

8. A vibration dampening attachment according to claim 7, wherein the attachment includes a plurality of said detent balls spaced circumferentially about the muzzle.

9. A vibration dampening attachment according to claim 8, wherein the attachment further includes a plurality of said axial grooves spaced circumferentially about the muzzle.

10. A vibration dampening attachment according to claim 7, wherein said attachment includes a plurality of said elongated axial grooves spaced circumferentially about the muzzle.

11. A vibration dampening attachment for a firearm barrel including a tubular weight attachable to the muzzle of the barrel by a threaded connection such that the tubular weight can be rotated to adjust it in position axially along the firearm barrel, so as to change the effective weight applied for dampening purposes, and the improvement comprising:

a tubular adapter attachable to the muzzle of said firearm barrel, fixed external threads on the tubular adapter and a plurality of elongated axial grooves formed in the external threads and spaced circumferentially about the tubular adapter, said tubular adapter including first and second opposite end portions said first end portion including said threads and grooves and said second end portion includes a plurality of axial slits spaced circumferentially about the second end portion of the adapter, and axial fingers between the slits, also spaced axially around the second portion of the adapter, and a clamp ring surrounding said second end portion of the adapter for squeezing radially inwardly on said fingers for clamping the adapter onto the muzzle, wherein said clamp ring is a ring of a temperature change responsive material which shrinks when subjected to the appropriate change in its temperature, and wherein shrinkage of the ring clamps the adapter in place on the firearm barrel, said tubular weight including an axial opening with internal threads which mate with said external threads; and at least one detent ball carried by the tubular weight and projecting radially inwardly from the internal threads of the tubular weight, for entry into said grooves, one groove at a time, in response to the tubular weight being rotated, wherein engagement of the detent ball within a groove holds the tubular weight in position relative to the muzzle, and wherein said detent ball and grooves provide for an axial position adjustment of the tubular weight in discreet increments along the barrel.

12. A vibration dampening apparatus according to claim 11, wherein said tubular weight includes a spring radially outwardly of the detent ball, said spring biasing the detent ball radially inwardly, and said detent ball acting radially outwardly on the spring during rotation of the tubular weight about the muzzle from each groove to the next groove.

13. A vibration dampening attachment according to claim 12, wherein the spring is a one piece axially split spring ring.

14. A vibration dampening attachment according to claim 13, wherein said spring ring includes a space at the axial split, and the attachment includes a block member in said space which is connected to the tubular weight and blocks said spring ring against a circumferential shifting in position about the tubular weight.

15. A vibration dampening attachment according to claim 14, wherein said tubular weight includes an inwardly tapering radial opening and said detent ball is positioned within said opening, and said spring ring is rotatable about the tubular weight between a first position in which the space is radially outwardly of the radial opening, permitting the detent ball to be inserted into and removed out from the radial opening via said space, and a second position in which the space is circumferentially to one side of said opening and a portion of said spring ring surrounds and is in contact with the detent ball.

16. A vibration dampening attachment according to claim 13, wherein said tubular weight includes a radially outwardly opening girth groove and said spring ring is located within said girth groove.

17. A vibration dampening apparatus according to claim 11, wherein said tubular weight is also a muzzle brake and includes a plurality of gas releasing sidewall openings.

18. A vibration dampening attachment for a firearm barrel including a tubular weight attachable to the muzzle of the barrel by a threaded connection such that the tubular weight can be rotated to adjust it in position axially along the firearm barrel, so as to change the effective weight applied for dampening purposes, and the improvement comprising:

a tubular adaptor attachable to the muzzle, fixed external threads on the tubular adapter and a plurality of elongated axial grooves formed in the external threads and spaced circumferentially about the tubular adapter, said tubular weight including an axial opening with internal threads which mate with said external threads, said tubular adapter includes first and second opposite end portions, said first end portion including said threads and said grooves, and said second end portion includes a plurality of circumferentially space apart axial slits, and axial fingers between the slits, said tubular adapter also including a clamp ring surrounding said second end portion, said clamp ring clamping the adapter onto the muzzle by squeezing radially inwardly on said fingers;

wherein said clamp ring is a ring of temperature change responsive material which shrinks when subjected to the appropriate change of its temperature, and wherein shrinkage of the clamp ring clamps the adapter in place on the muzzle; and at least one detent ball carried by the tubular weight and projecting radially inwardly from the internal threads of the tubular weight, for entry into said grooves, one groove at a time, in response to the tubular weight being rotated, wherein engagement of the detent ball within a groove holds the tubular weight in position relative to the muzzle, and wherein said detent ball and grooves provide for an axial position adjustment of the tubular weight in discreet increments along the barrel.

19. A vibration dampening attachment according to claim 18, wherein the spring is a one piece axially split spring ring.

20. A vibration dampening attachment according to claim 19, wherein said spring ring includes a space at the axial split, and the attachment includes a block member in said space which is connected to the tubular member and blocks said spring ring against a circumferential shifting in position about the tubular weight.

21. A vibration dampening attachment according to claim 18, wherein said tubular weight includes an inwardly tapering radial opening in said detent ball is positioned within said opening and said spring ring is rotatable about the tubular weight between a first position in which the space is radially outwardly of the radial opening, permitting the detent ball to be inserted into and removed out from the radial opening via said space, and a second position in which the space is circumferentially to one side of said opening and a wall portion of said spring ring surrounds and is in contact with the detent ball.

22. A vibration dampening attachment according to claim 18, comprising at least two detent balls carried by the tubular weight and projecting radially inwardly from the tubular weight, each for entry into one of said grooves.

23. A vibration dampening attachment according to claim 18, including between five to ten axial grooves formed in the external threads.

24. A vibration dampening attachment according to claim 23, including at least two detent balls carried by the tubular weight, each said detent ball projecting radially inwardly from the tubular weight each for entry into a said groove.

25. A vibration dampening attachment according to claim 18, wherein said tubular weight is also a muzzle brake and includes a plurality of gas releasing sidewall openings.

26. A vibration dampening attachment for a firearm barrel including a tubular weight attachable to the muzzle of the barrel by a threaded connection such that the tubular weight can be rotated to adjust it in position axially along the firearm barrel, so as to change the effective weight applied for dampening purposes, and the improvement comprising:

a tubular adaptor attachable to the muzzle;

fixed external threads on the tubular adapter;

said tubular weight including an axial opening with internal threads which mate with said external threads; and said tubular adapter includes first and second opposite end portions, said first end portion including said threads, and said second end portion includes a plurality of circumferentially space apart axial slits, and axial fingers between the slits, said tubular adapter also including a clamp ring surrounding said second end portion, said clamp ring clamping the adapter onto the muzzle by squeezing radially inwardly on said fingers, wherein said clamp ring is a ring of temperature change responsive material which shrinks when subjected to the appropriate change of its temperature, and wherein shrinkage of the clamp ring clamps the adapter in place on the muzzle, and wherein said tubular weight is rotated on the threads to provide for an axial position adjustment of the tubular weight along the barrel.

27. A vibration dampening attachment according to claim 26, wherein said tubular weight is also a muzzle brake and includes a plurality of gas releasing sidewall openings.

* * * * *